US011522262B1

(12) United States Patent
Foti

(10) Patent No.: US 11,522,262 B1
(45) Date of Patent: Dec. 6, 2022

(54) WAVEGUIDE COMBINER/DIVIDER HAVING PLURAL INPUT/OUTPUT PORTS WITH LONGITUDINAL EXTENT

(71) Applicant: Werlatone, Inc., Brewster, NY (US)

(72) Inventor: Stephen J. Foti, Northumberland (GB)

(73) Assignee: Werlatone, Inc., Patterson, NY (US)

( * ) Notice: Subject to any disclaimer, the term of this patent is extended or adjusted under 35 U.S.C. 154(b) by 0 days.

(21) Appl. No.: 17/584,252

(22) Filed: Jan. 25, 2022

(51) Int. Cl.
*H01P 5/18* (2006.01)

(52) U.S. Cl.
CPC ..... *H01P 5/182* (2013.01); *H01P 5/188* (2013.01)

(58) Field of Classification Search
CPC ..... H01P 5/18; H01P 5/182; H01P 5/188
USPC ..... 333/248, 239, 244
See application file for complete search history.

(56) References Cited

U.S. PATENT DOCUMENTS 3,218,580 A 11/1965 Zanichkowsky
3,958,193 A * 5/1976 Rootsey ..... H01P 5/12 333/125
4,167,715 A * 9/1979 Ohm ..... H01P 1/161 333/251
4,395,685 A * 7/1983 Davies ..... H01P 1/173 333/125
4,583,061 A 4/1986 O'Shea
4,590,446 A 5/1986 Hsu et al.
4,599,584 A 7/1986 Sasser et al.
4,673,899 A 6/1987 Jespersen et al.
4,947,143 A 8/1990 Abouzahra et al.
5,256,988 A * 10/1993 Izadian ..... H03F 3/602 333/34
9,419,323 B2 * 8/2016 Shinohara ..... H01P 5/12
9,979,067 B2 * 5/2018 Danderson ..... H01P 5/16
10,658,727 B1 * 5/2020 Foti ..... H01P 5/12
(Continued)

FOREIGN PATENT DOCUMENTS

DE 882430 C 7/1953

OTHER PUBLICATIONS

Secmen, M., et al., E-plane Sectoral Horn Power Divider, The Institution of Engineering and Technology, vol. 4, Iss. 2, 2010, pp. 191-199, 9 pages.

(Continued)

*Primary Examiner* — Samuel S Outten
*Assistant Examiner* — Alan Wong
(74) *Attorney, Agent, or Firm* — Kolisch Hartwell, P.C.

(57) ABSTRACT

A combiner/divider includes a plurality of input/output waveguides distributed in a plane and diverging in at least a partially common direction away from a central point. Each input/output waveguide extends from an outer node disposed distal of the central point to an inner port proximate to and spaced from the central point. Each input/output waveguide has a respective dimension in the plane that increases between the inner port and the outer node. An output/input waveguide has an aggregate port proximate to the central point and facing the inner ports. A transition waveguide defines an open cavity that flares outwardly in the plane from the aggregate port toward the inner ports and communicatively couples the output/input waveguide with the input/output waveguides. Opposing distal surfaces of the transition waveguide and inner port edges are spaced apart by a distance that decreases with increasing distance from the aggregate port.

19 Claims, 7 Drawing Sheets

(56) References Cited

U.S. PATENT DOCUMENTS

| | | | |
|---|---|---|---|
| 2005/0174194 | A1 | 8/2005 | Wu et al. |
| 2019/0058233 | A1 | 2/2019 | Hirota et al. |

OTHER PUBLICATIONS

Ning, Yuemin, et al., A New Spatial Power Combiner Based on 32-way Ridged Waveguides, Science and Technology on Electronic Test & Measurement Laboratory, IEEE, 2014, 4 pages.

Abed, Amer Tawfeeq, Study of Radiation Properties in Taylor Distribution Uniform Spaced Backfire Antenna Arrays, American Journal of Electromagnetics and Applications, vol. 2, Nov. 3, 2014, pp. 23-26, 4 pages.

Nikolova, Lecture 18: Horn Antennas, McMaster University, Department of Electrical & Computer Engineering, Dec. 13, 2016, 29 pages.

Haro-Baez et al., Development of Radial Waveguide Dividers with Large Number of Ports, 2015 Asia-Pacific Conference on Computer Aided System Engineering, Conference Paper, Jul. 2015, 6 pages.

* cited by examiner

WAVEGUIDE COMBINER/DIVIDER HAVING PLURAL INPUT/OUTPUT PORTS WITH LONGITUDINAL EXTENT

FIELD

The present disclosure relates generally to power combiners/dividers in radio frequency (RF) devices, and specifically to N-way waveguide or coaxial power combiners/dividers.

BACKGROUND

When it is desirable to combine many high-power input signals to achieve an extremely high-power output signal with very low-loss, 360-degree radial waveguide power combiners are typically employed. Such radial waveguide power combiners typically incorporate waveguide or coaxial input port geometries. The input signals are then combined in the center of the radial waveguide by a transition from radial waveguide to a transverse electro-magnetic (TEM) mode coaxial transmission line. The coaxial transmission line is utilized because of its circular symmetry to achieve a high degree of amplitude and phase balance of the input signals for efficient combining. The coaxial transmission line must operate in its lowest order (TEM) mode in order to maintain amplitude and phase balance. This necessitates the cross-sectional dimensions of the coaxial transmission line to be below a threshold which depends upon the operating frequency range in order to render any undesirable higher order modes evanescent by decaying sufficiently to avoid perturbing the amplitude and phase balance. Invoking this cross-sectional dimension constraint on the coaxial transmission line limits both the peak and average power levels that can be achieved without component failure.

Power combiners may also be employed that extend along an arc of less than 180-degrees. Such combiners may include input waveguides that extend in a fan shape from a port of an output waveguide. Inner ends of walls separating the input waveguides may be truncated due to manufacturing limitations or due to wall design. Abrupt discontinuities necessarily occur at the truncated input waveguide wall tips that may cause undesirable reflections of the internal guided waves.

SUMMARY

The present disclosure is directed to a combiner/divider having a transition cavity that extends along a length of the inner ports of a plurality of input/output waveguides. In some embodiments the combiner/divider includes a three-dimensional output/input waveguide, a plurality of three-dimensional input/output waveguides, and a three-dimensional transition waveguide coupling the output/input waveguide to the plurality of input/output waveguides. A plurality of output/input walls has respective output/input-wall faces that define the output/input waveguide having an aggregate port. A plurality of input/output walls have input/output-wall faces defining the plurality of input/output waveguides distributed along a plane in side-by-side relationship. Each input/output waveguide extends from an outer node disposed distal of the aggregate port to an inner port proximate to and spaced from the aggregate port. The inner port of each input/output waveguide extends from an extremity port end proximate to the aggregate port along a limited length of the respective input/output waveguide to a completion-port end distal of the aggregate port. The input/output-wall faces extend laterally discontinuously around the respective input/output waveguide at the extremity port end and along the limited length of the respective input/output waveguide. The input/output walls extend laterally continuously around each input/output waveguide at the respective completion-port end. A plurality of transition walls has respective transition-wall faces defining a transition waveguide with an open cavity communicatively coupling the aggregate port to each of the inner ports.

In some embodiments, the combiner/divider includes a plurality of output/input walls having respective output/input-wall faces defining a three-dimensional output/input waveguide having an aggregate port. A plurality of transition walls has respective transition-wall faces defining a three-dimensional transition waveguide with an open cavity communicatively coupled to the aggregate port. The cavity includes a distal region that is spaced from the aggregate port. The transition waveguide includes opposing first and second distal surfaces in the distal region that are spaced apart by a distance that decreases with distance from the aggregate port. A plurality of input/output walls have input/output-wall faces defining a plurality of three-dimensional input/output waveguides distributed along a plane in side-by-side relationship. Each input/output waveguide is communicatively coupled to the cavity of the transition waveguide and thereby communicatively coupled to the aggregate port. Each input/output waveguide extends from an outer node disposed distal of the aggregate port to an inner port proximate to and spaced from the aggregate port. Each inner port extends toward the aggregate port along at least one of the first and second distal surfaces.

In some embodiments, a combiner/divider includes a plurality of input/output waveguides distributed in a plane and diverging in at least a partially common direction away from a central point. Each input/output waveguide of the plurality of input/output waveguides extends from an outer node disposed distal of the central point to an inner port proximate to and spaced from the central point. Each of the plurality of the input/output waveguides has a respective dimension in the plane that increases between the inner port and the outer node. An output/input waveguide has an aggregate port proximate to the central point and facing the inner ports of the plurality of input/output waveguides. A transition waveguide defines an open cavity extending from the aggregate port of the output/input waveguide to the inner ports of the plurality of input/output waveguides. The transition waveguide flares outwardly in the plane from the aggregate port toward the inner ports and communicatively couples the output/input waveguide with the plurality of input/output waveguides. The cavity includes a distal region distal of the aggregate port and the transition waveguide includes opposing first and second distal surfaces in the distal region that are spaced apart by a distance that decreases with increasing distance from the aggregate port.

Features, functions, and advantages may be achieved independently in various embodiments of the present disclosure, or may be combined in yet other embodiments, further details of which can be seen with reference to the following description and drawings.

BRIEF DESCRIPTION OF THE DRAWINGS

Additional aspects of combiners/dividers will become evident upon reviewing the non-limiting embodiments described in the description and the claims taken in conjunction with the accompanying figures, in which:

DESCRIPTION

Overview

Figure 1:
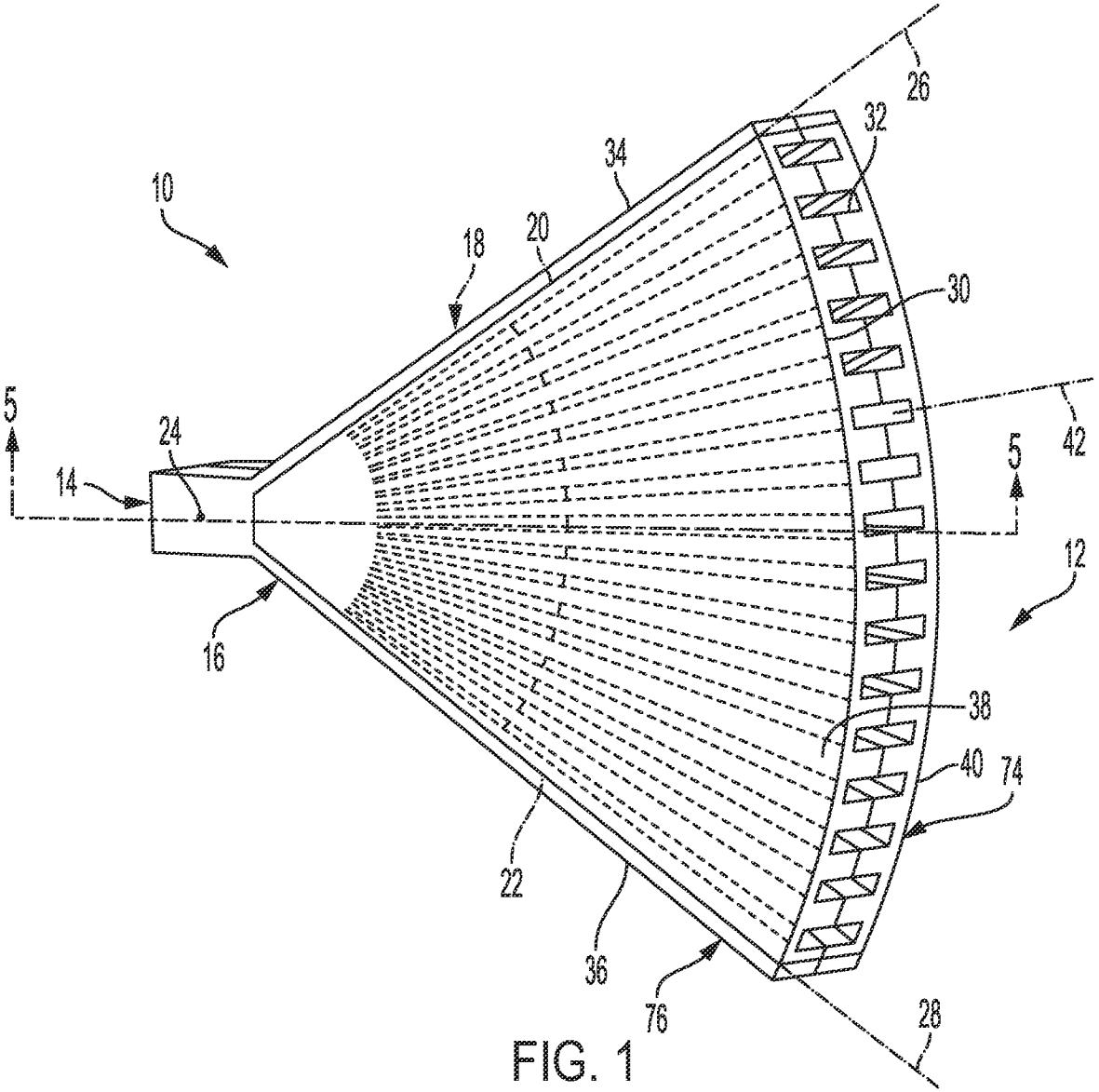
FIG. 1 is an isometric view of an example of a 16-way combiner/divider having 16 tapered input/output waveguides stacked in their E-Planes within a radial sector structure.
Figure 2:
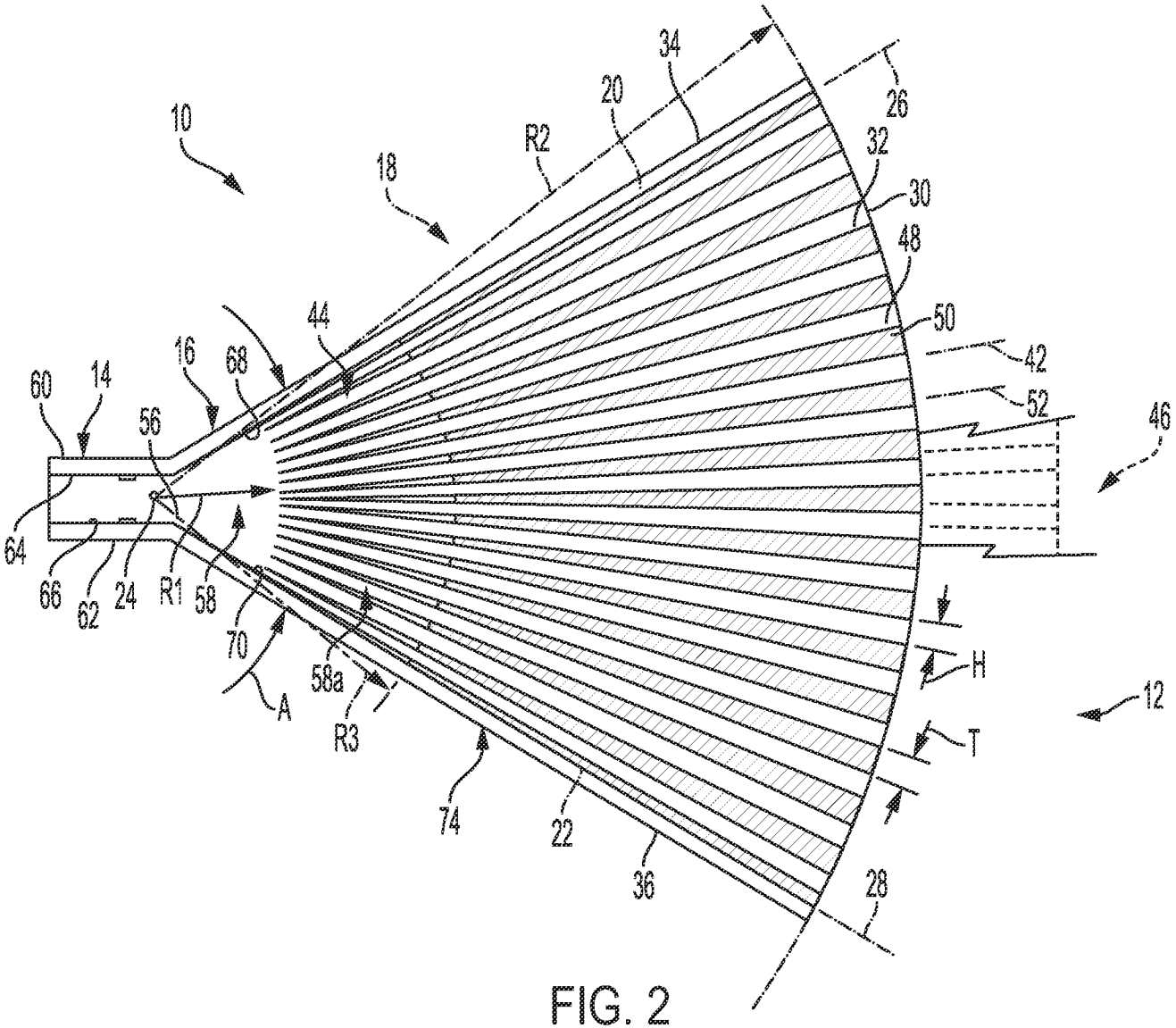
FIG. 2 is a cross-section of the combiner/divider of FIG. 1 taken along a plane containing the 16 input/output waveguides.
Figure 3:
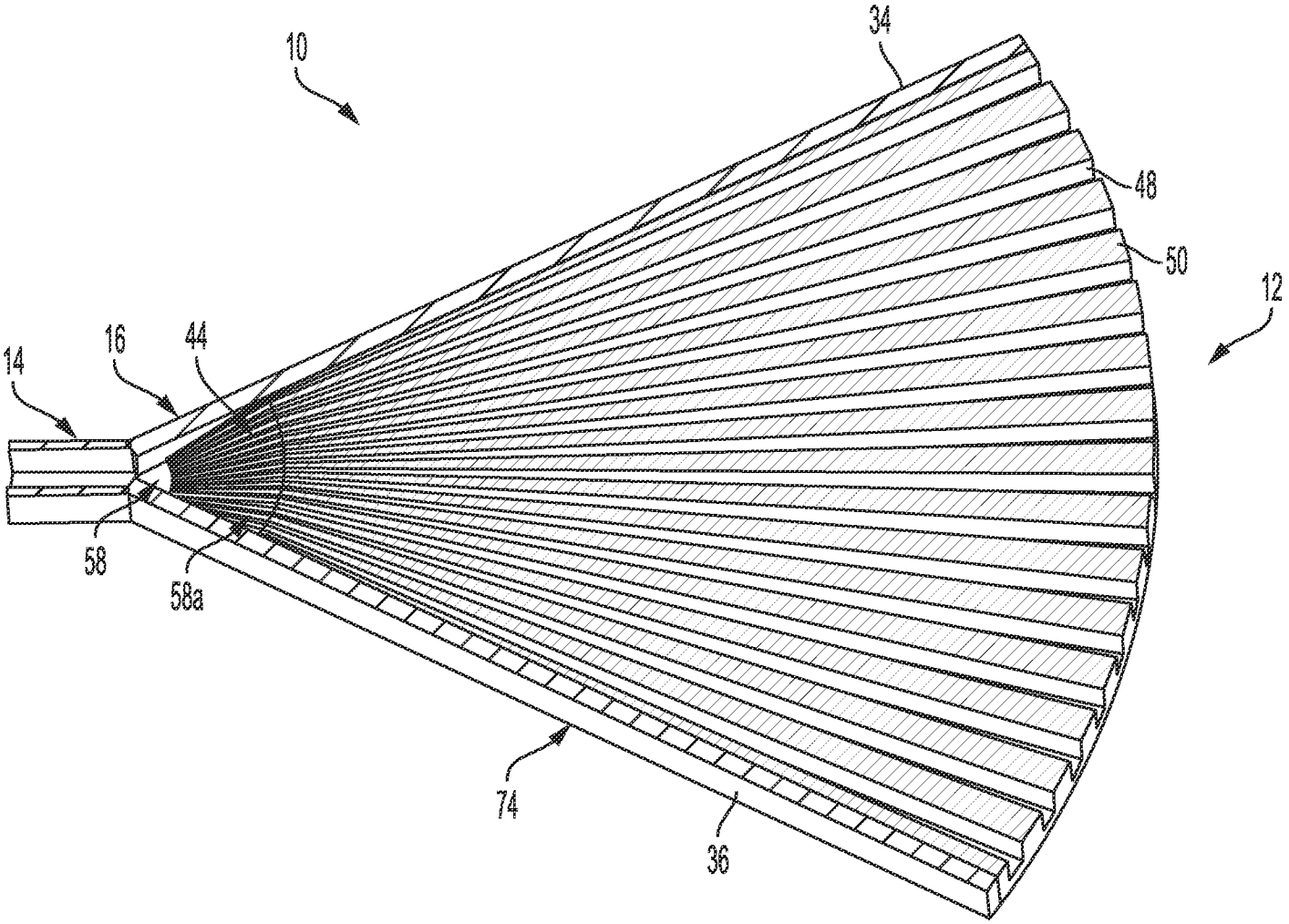
FIG. 3 is an isometric view of the combiner/divider portion shown in cross section in FIG. 2.

Various embodiments of a combiner/divider coupling a plurality of input/output waveguides to an output/input waveguide are described below and illustrated in the associated drawings. Unless otherwise specified, a combiner/divider and/or its various components may, but is not required to, contain at least one of the structure, components, functionality, and/or variations described, illustrated, and/or incorporated herein. Furthermore, the structures, components, functionalities, and/or variations described, illustrated, and/or incorporated herein may, but are not required to, be included in other combiners and/or dividers. The following description of various embodiments is merely exemplary in nature and is in no way intended to limit its scope, applications, or uses. Additionally, the advantages provided by the embodiments, as described below, are illustrative in nature and not all embodiments provide the same advantages or the same degree of advantages.

Generally, a combiner/divider as disclosed herein includes a transition waveguide interposed between a plurality of input/output waveguides and an output/input waveguide. In the embodiments described herein, the input/output waveguides are the same and are distributed in a radial sector. It will be appreciated that other configurations may be realized for other applications for providing the same or different signal amplitudes and phases. The input/output waveguides extend from inner ports disposed proximate to and spaced from a sector center to outer nodes disposed along an arc of the sector. The input/output waveguides may taper in size or be constant in size between the inner ports and the outer nodes. The inner ports preferably extend longitudinally along inner ends of the input/output waveguides. A surface or surfaces extending between the inner ports of adjacent input/output waveguides also preferably are configured to conform to the configurations of the inner ports. In general, the output/input waveguide has an aggregate port, facing and spaced from the inner ports of the input/output waveguides. A transition waveguide includes a cavity that extends between the input/output waveguides and the output/input waveguide and narrows progressively in width along the inner ports.

Definitions

The structures disclosed herein may be used as either combiners or dividers. The general term "combiner/divider" identifies both functions, with the applicable function depending on the use of the structure. When used as a combiner, the input/output waveguides function as input waveguides, and an output/input waveguide functions as an output waveguide. Correspondingly, when used as a divider, the output/input waveguide functions as an input waveguide and the input/output waveguides function as output waveguides.

"Waveguide" refers to a three-dimensional waveguide having an internal channel defined by inner surfaces of walls on the sides for transmitting electromagnetic waves by successive reflections from the wall inner surfaces.

"Sector" refers to a geometrical figure bounded by two equal-length outer radii extending from a common center and an included arc of a circle connecting outer ends of the outer radii.

"Node" refers to a point on an electrical circuit where a characteristic of the circuit may be identified. A port or a terminal is considered a node of a circuit structure that provides external access or represents an end of a circuit component or structure, such as a waveguide.

Example

FIGS. 1-7 illustrate selected aspects of an exemplary combiner/divider. This example is intended for illustration and should not be interpreted as limiting the entire scope of the underlying concepts. In FIGS. 1-7, a combiner/divider is disclosed that can be used to guide high power signals at low loss. As a combiner it is configured to efficiently combine a plurality of input signals directly into an aggregate signal at an aggregate port of an output waveguide. The resultant power combiner's output power level capability can approach that of the sum of the input waveguides. This is typically orders of magnitude greater than the maximum power that could be achieved in designs that incorporate coaxial transmission line sections such as radial waveguide power combiners.

For example, for the rectangular waveguide WR159 recommended waveguide frequency band of 4.9-7.05 GHz, the peak power handling is 2.79 Mw and the average power handling is 15 Kw using copper waveguide material. A plurality of input/output waveguides are stacked in their E-Planes within a radial sector and taper down in height from input/output ports of the input/output waveguides toward the output/input waveguide where the signals from all the input/output waveguides are added to produce extremely high output power when operating in a combiner mode. This combiner design structure is more compact and lower-loss than other high-power waveguide combiner/divider designs which, for example, are comprised of a multiplicity of cascaded "Magic-T" 2-way waveguide combiner/dividers in a corporate arrangement.

In the example embodiment shown in FIGS. 1-7, an equal amplitude and phase 16-Way combiner/divider has sixteen waveguide input/output ports positioned on a circular arc within a radial sector of subtended angle A. Any practical number, N, of input/output waveguides can be employed and N can be any appropriate positive integer greater than or equal to 2, i.e., N does not have to be a power of 2. The input/output waveguides are spaced on a circular arc such that there is sufficient area around each input/output waveguide outer port for connection to the waveguide flange of an external input/output device, such as an amplifier. Alternatively, if coaxial inputs/outputs are preferred for a particular embodiment, then end-launch or top-launch coaxial-to-waveguide transitions may be employed and these can be connected to the areas around each input/output waveguide outer port. The central axes of the input waveguides are oriented such that they are normal to the circular arc of the radial sector. These input/output waveguide axes intersect at the center or origin of the radial sector near the location of the output/input waveguide.

When operating in the combiner mode, the input waveguides are preferably tapered in their heights and continue to be reduced in their heights until they arrive close to the origin of the radial sector near the location of the output waveguide, i.e., in a cavity region at the inner ends of the input waveguides. The tapered input waveguides are at their minimum heights at their ends close to the origin of the radial sector where the top and bottom walls of the input waveguides end at inner ports that extend longitudinally along a limited length of the input waveguides. The input waveguides radiate into the cavity region between their truncated ends and the output waveguide. If all the input waveguides have input signals that are equal in amplitude and in-phase, then when these signals arrive at the longitudinally tapered inner ports of the input waveguides the radiated electric fields from each of them constructively add and form a composite or aggregate electric field distribution which closely matches the electric field distribution required in the output waveguide so that any reflections are low. Any small reflections can easily be compensated by the inclusion of small scattering objects (not shown in the figures), such as posts or irises, known to those skilled in the art.

The top and bottom waveguide walls of the input/output waveguides are preferably tapered in their thicknesses to achieve a compact design and also to reduce the sizes of their inner ends. This allows the E-fields of the input waveguides to provide a more continuously uniform E-field distribution to closely match the preferred uniform E-field distribution of the output/input waveguide. However, for lower frequencies, the input/output waveguide walls may be constant in thickness preferably as long as the thickness is a very small portion of a wavelength.

Typically, a combiner/divider is formed in two mirror image halves with each half forming a respective half of the N input waveguides. In order to mitigate the signal reflections resulting from abruptly truncated inner ports of the input waveguides, portions of the walls between the inner ports are removed, preferably in a graduated fashion along a length of the input waveguides. The reflections produced at these longitudinally extended inner ports are smaller and are produced at positions along the longitudinal extent of the inner ports rather than at a single longitudinal position as is the case with an abruptly truncated inner port. The reflections occurring at distributed positions along a limited length of the inner waveguides do not add up coherently, and thus reduce the overall composite reflection. A typical embodiment of the combiner uses a conical-curve shaped cut-out or space in the input/output waveguide walls, but a variety of cut-out shapes can be employed such as stepped or exponential curve shaped cut-outs.

Specifically, FIGS. 1-7 illustrate a combiner/divider 10 made of electrically conductive material, such as copper or aluminum, and having a plurality of input/output waveguides 12. In this example, there are sixteen input/output waveguides 12, although any suitable number of waveguides may be used subject to manufacturing tolerances. The input/output waveguides may be positioned side-by-side, such as in a sector as shown in the figures, in a circle as for a radial combiner, or other configuration. Input/output waveguides 12 are communicatively coupled to an output/input waveguide 14 via a transitional waveguide 16.

In this example, input/output waveguides 12 and transitional waveguide 16 are positioned in the configuration of a radial sector 18 defined by outer radii 20, 22, that extend from a center 24 along respective radial lines 26, 28, and an arc 30 extending between the outer radii at outer input/output waveguide nodes 32. In this example, outer nodes 32 are also distal input/output ports of input/output waveguides 12. The input/output waveguides are stacked side-by-side in sector 18 in a plane corresponding to the plane of sector 18 and the plane of view of FIG. 2, which is in the E-planes of the input/output waveguides.

Arc 30 subtends an angle A of 60 degrees, although other angles may be used as appropriate for a given application and number of input/output waveguides. In a sector configuration, it is preferable that the input/output waveguides extending from a center 24 extend at least partially in a common direction. With combiner/divider 10, each of input/output waveguides 12 extend at least partially to the right as viewed in FIG. 2.

A subtended angle of 60 degrees is found to provide a good compromise between a very small subtended angle which would require a very long structure to accommodate the width of the input/output nodes 32 (either as waveguides or coaxial connectors) and a larger subtended angle for which the input waves from the uppermost and lowermost input/output waveguides 12 would arrive at the aperture (inner port) of output/input waveguide 14 approaching a "sideways" incident condition (which would occur at the extreme value of 180 degree subtended angle). This could cause the coupling of end input/output waveguides 12 to output/input waveguide 14 to be weaker than the central ones and that would degrade amplitude balance. The advantage of large subtended angles is the reduction of the length of the combiner for a given number of input/output waveguides. A sector angle of 60 degrees thus provides a balance of combiner length and electrical performance, depending on the number of input/output waveguides that are being combined. That being said, the subtended angle could be anywhere from a very small angle approaching 0 degrees to an angle approaching 180 degrees when coupling to a three-dimensional waveguide.

Side walls 34, 36 extend from output/input waveguide 14 along respective radial lines 26, 28 to arc 30. Opposite face plates 38, 40 extend parallel to the plane of sector 18 between side walls 34, 36, with side walls 34, 36 and face plates 38, 40 enclosing the input/output waveguides 12, output/input waveguide 14, and transition waveguide 16.

In this example, input/output waveguides 12 extend along respective radial lines, such as radial line 42, extending from center 24. All of the input/output waveguides are of equal dimensions providing equal phase and amplitude of signals guided by the input/output waveguides. As shown particularly in FIG. 2, each input/output waveguide 12 has a height H in the E-plane that is transverse to the length of the input/output waveguide. In this example, height H increases along the entire lengths of the input/output waveguides between inner ports 44 and outer nodes 32.

Inner ports 44 extend along a limited longitudinal length L of the input/output-waveguides. The length L is selected based on the configuration, application, and manufacturing limitations of the particular combiner/divider. The length L extends from the very inner end of each input/output waveguide 12 proximal to center 24 and output/input waveguide 14, referred to as an extremity port end 44*a*, to a completion port end 44*b* spaced length L along the input/output-waveguides toward outer nodes 32 from the extremity port end. Extremity port ends 44*a* are aligned in an arc having a radius R1 from center 24, completion port ends are aligned in an arc having a radius R3 from center 24, and outer nodes 32 along arc 30 are located at a radius R2 from center 24. Radius R3 is thus equal to radius R1 plus length L.

The lengths of the tapered input/output-waveguides are thus the difference between radii R1 and R2. Specifically, waveguide height H increases linearly from extremity port end 44*a* of inner port 44 to outer node 32. It will be appreciated that beyond inner ports 44 and outer nodes 32, input/output waveguides 12 could extend further and have other configurations. For example, there could be a section 46 of combiner/divider 10 that extends beyond arc 30 in which the heights of the input/output waveguides are constant, as illustrated by a fragmentary portion shown in dashed lines.

In combiner/divider 10, input/output waveguides 12 typically vary continuously linearly between inner ports 44 and outer nodes 32, but may be of a constant height, and also may vary in height in a nonlinear fashion, such as exponentially. The input/output waveguides may have wall faces defining the waveguides, such as faces 48 of transverse walls 50 that are transverse to the plane of sector 18 and extend along radial lines, such as radial line 52, along the lengths of the input/output waveguides between inner ports 44 and outer nodes 32. As mentioned, the heights of the input/output waveguides can vary linearly or nonlinearly along their lengths. As a result, the dimension T of the distance separating the wall faces of adjacent input/output waveguides also increases linearly from inner ports 44 to outer nodes 32. In this example dimension T, which corresponds to the thicknesses of walls 50, will be the result of a desired design in the configurations of the input/output waveguides. Walls 50, shown as being continuous between adjacent waveguide wall faces may be comprised of two or more separate walls, such as waveguide walls of constant thickness. Walls of constant thickness T increase the amount of taper available for the input/output waveguides for a given sector angle, which results in a more compact structure size, but also may result in a thicker exposed surface between adjacent inner ports.

Figure 4:
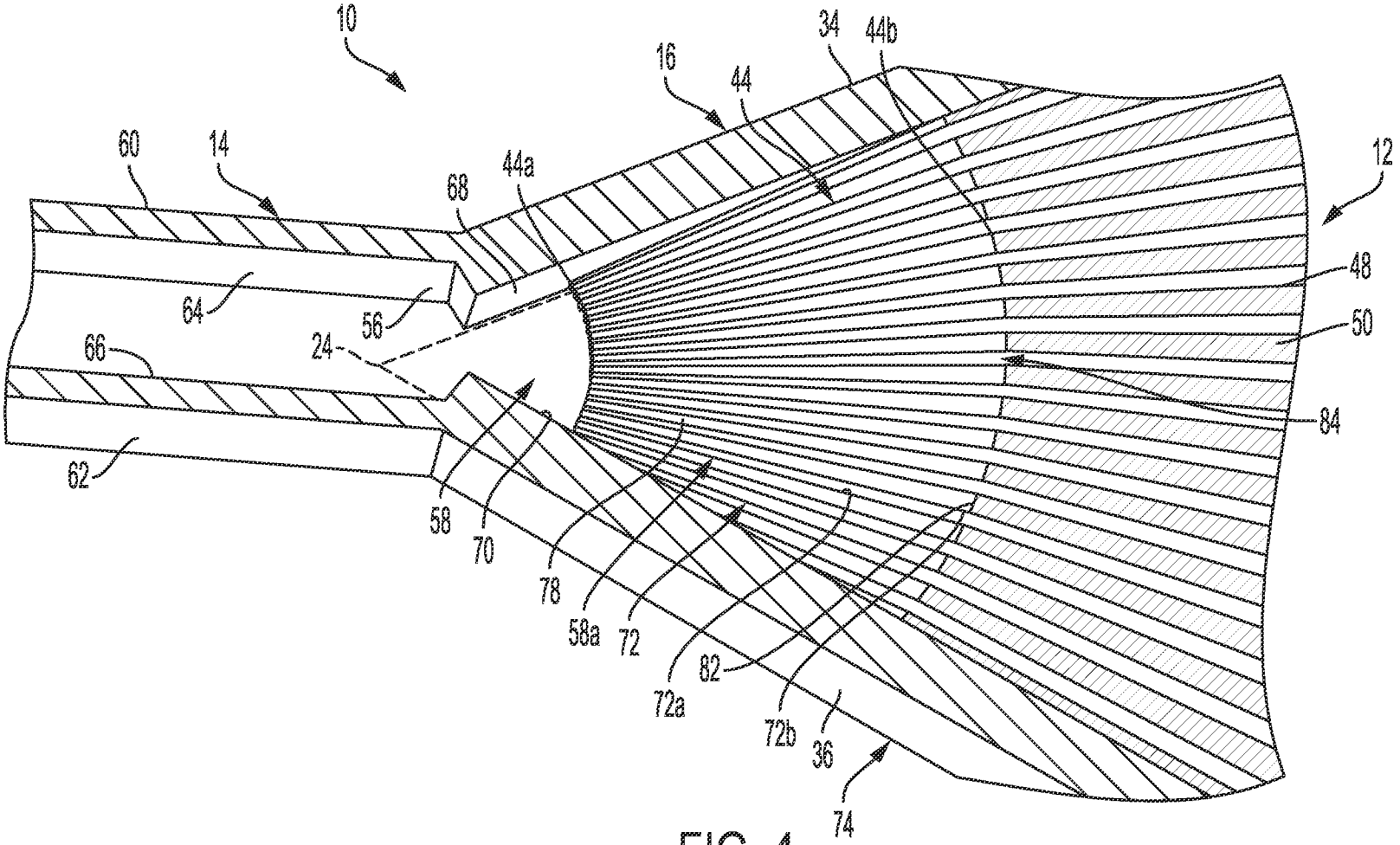
FIG. 4 is an enlarged view of a portion of the combiner/divider portion shown in FIG. 3 showing details of an output/input waveguide, transition waveguide, and longitudinally extended inner ports of the input/output waveguides.
Figure 5:
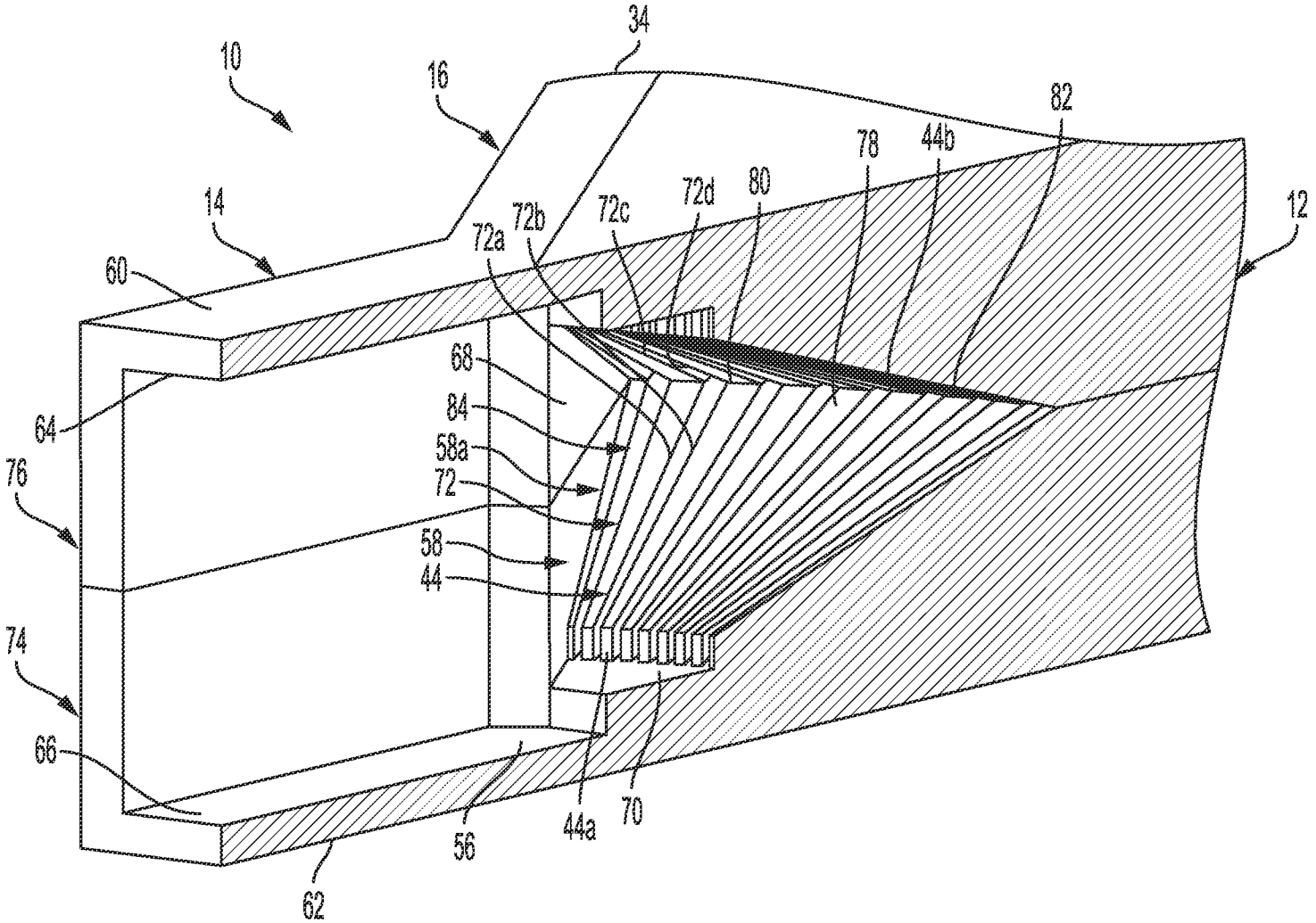
FIG. 5 is an enlarged cut-away isometric view of a portion of the combiner/divider of FIG. 1 shown in cross-section taken along line 5-5 of FIG. 1, which is a plane normal to the plane of view of FIG. 2 showing details of the output/input waveguide, transition waveguide, and longitudinally extending inner ports for 8 of the 16 input/output waveguides.
Figure 6:
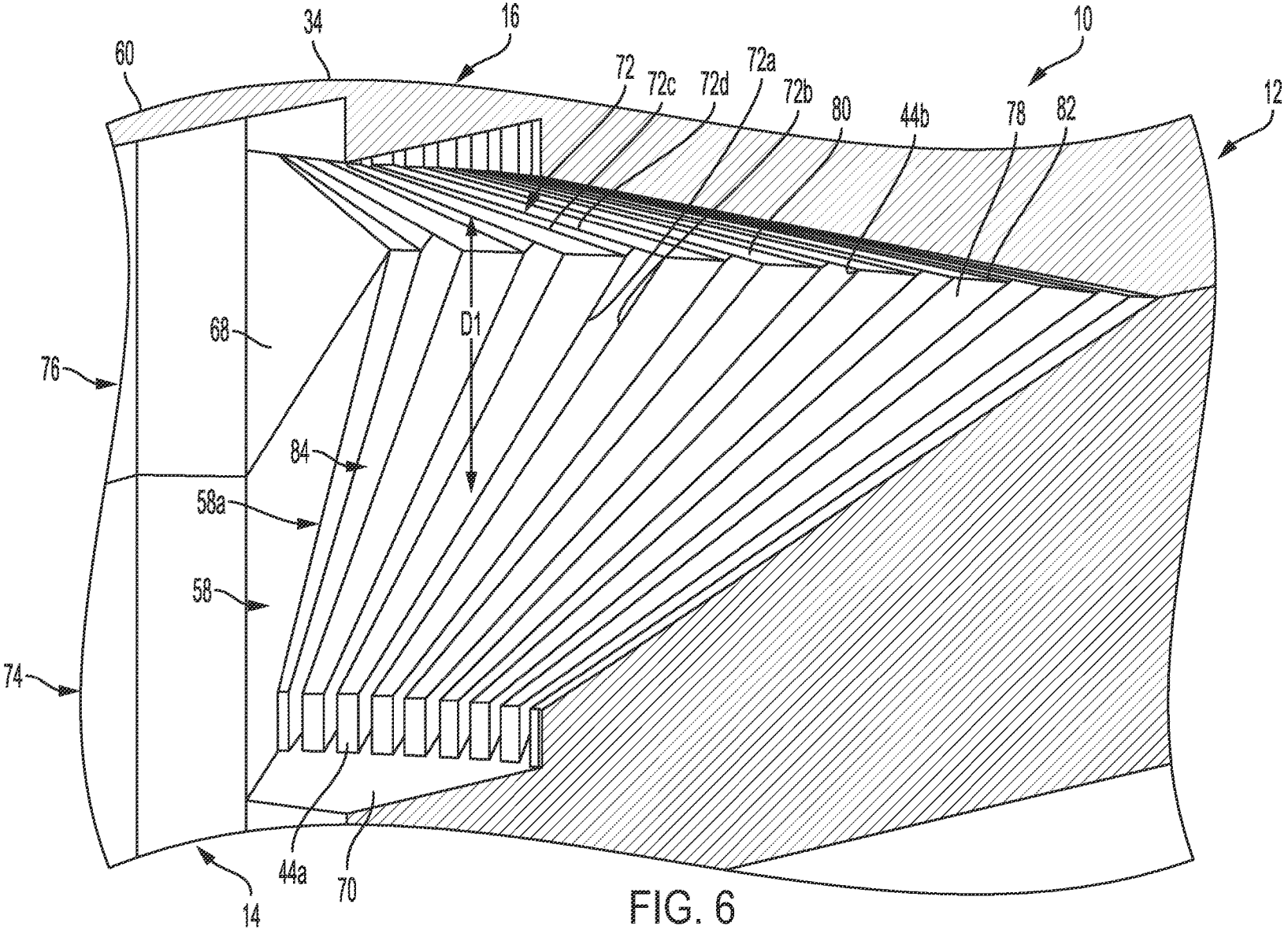
FIG. 6 is an enlargement of a portion of FIG. 5.

Referring to FIGS. 4-6, further details of the inner ports 44 of input/output waveguides 12, output/input waveguide 14, and transition waveguide 16 are shown. A plurality of output/input walls, including upper wall 60 and lower wall 62, have respective output/input-wall faces, including faces 64 and 66, that define output/input waveguide 14 having an aggregate port 56. Walls 60 and 62 contact outer walls 34 and 36 of transition waveguide 16.

Transition waveguide 16 is formed by faces of respective walls, including faces 68 and 70 of outer walls 34 and 36. Transition waveguide 16 has an open cavity 58 extending between aggregate port 56 of output/input waveguide 14 and inner ports 44 of input/output waveguides 12. Cavity 58 has no internal waveguide walls within it between the aggregate port and the inner ports. The transition waveguide flares outwardly in the E-plane from the inner port of the output/input waveguide toward the inner ports of the input/output waveguides and communicatively couples the output/input waveguide with the plurality of input/output waveguides. It is seen that the heights H of input/output waveguides 12 at the inner ports are very small compared to the heights H at the outer nodes 32. Similarly, the tapered walls vary from a small value of thickness T at the inner ports compared to the thickness T at the outer nodes.

FIG. 5 illustrates a cut-away view of combiner/divider 10 taken along line 5-5 of FIG. 1. FIG. 6 is an enlarged view of a portion of the view of FIG. 5 to show details associated with transition waveguide 16, cavity 58, and inner ports 44. Combiner/divider 10 is formed of two combiner/divider components 74 and 76 that are mirror images of each other so that when they are assembled as shown in FIG. 5 they form combiner/divider 10.

Input/output-wall faces 48 include input/output waveguide edges 72 that define the inner ports. Waveguide edges 72 include pairs of opposing first and second waveguide edges 72*a* and 72*b* that extend along combiner/divider component 74 from the respective extremity port end 44*a* to the respective completion port end 44*b* of each inner port 44. Correspondingly, waveguide edges 72 include opposing third and fourth waveguide edges 72*c* and 72*d* that extend along combiner/divider component 76 from the respective extremity port end 44*a* to the respective completion port end 44*b* of each inner port 44. Each inner port 44 thus includes waveguide edges 72*a*, 72*b*, 72*c*, and 72*d*, as well as inner-port ends 44*a* and 44*b*. Waveguide edge 72*a* is opposite waveguide edge 72*c*, and correspondingly, waveguide edge 72*b* is opposite waveguide edge 72*d*. In this example, combiner/divider components 74 and 76 are mirror images of each other. Accordingly, the portion of each inner port on combiner/divider component 74 is a mirror image of the portion of the respective inner port on combiner/divider component 76.

At completion port end 44*b*, the input/output waveguide wall faces extend laterally continuously around the faces of each the input/output waveguide, i.e., are complete, as they do from completion port end 44*b* to outer nodes 32. From completion port end 44*b* to extremity port end 44*a*, however, increasing portions of two opposing waveguide faces are absent. Said another way, the input/output-wall faces 48 extend laterally discontinuously around each input/output waveguide at the respective extremity port end 44*a* and also along limited length L of the respective input/output waveguide. Accordingly, the distance D1 between the waveguide edges 72*a* and 72*c* and also between waveguide edges 72*b* and 72*d* of each of the inner ports decreases with increasing distance away from aggregate port 56 and center 24.

In this example, at least a portion of each of waveguide edges 72*a*, 72*b*, 72*c*, and 72*d* extends in a straight line between extremity port end 44*a* and completion port end 44*b*. As will be seen with reference to FIGS. 7-10 discussed further below, waveguide edges 72*a*, 72*b*, 72*c*, and 72*d* can have other configurations.

In conformity with the configuration of the inner ports, transition waveguide 16 has wall faces defining cavity 58 that correspond with the configuration of the inner ports. Cavity 58 therefore includes a distal region 58*a* spaced from aggregate port 56, and transition waveguide 16 includes opposing first and second distal surfaces 78 and 80 in the distal region that are spaced apart by distance D1, which distance decreases with distance from the aggregate port and center 24. Distal surface 78 is on combiner/divider component 74 and distal surface 80 is on combiner/divider component 76. Preferably, the cavity extends continuously between the waveguide edges of adjacent inner ports of the plurality of input/output waveguides along transition-waveguide distal surfaces 78 and 80 that are distal of the aggregate port.

The transition-waveguide distal surfaces preferably conform to the adjacent waveguide edges of respective adjacent inner ports. Distal surfaces 78 and 80 are mirror images of each other and converge distal of the aggregate port at an extremity edge 82 aligned with the inner-port extremity port ends 44*a*. As mentioned, the distal surfaces preferably conform to conical-curve shaped cut-outs or spaces in the input/output waveguide walls. As particularly shown in FIGS. 4-6, the collective waveguide edges and associated distal surfaces extending between adjacent waveguide edges of adjacent inner ports thus preferably conform to corresponding portions of conical surfaces. Distal surface 78 thus conforms to a portion of one conical surface and distal surface 80 conforms to a portion of another conical surface. A conical surface is a continuously curved surface, and each wall surface between adjacent waveguides forming a portion of a distal surface is also preferably curved in conformance to the overall conical-curve shape, as particularly shown in FIG. 4

Accordingly, waveguide edges 72*a* and 72*c* of the inner ports extend along distal surface 78 and waveguide edges 72*b* and 72*d* of the inner ports extend along distal surface 80 from the input/output waveguides toward the aggregate port. The channels of the input/output waveguides appear as openings 84 at inner ports 44 in distal surfaces 78 and 80.

Additional Examples

FIGS. 7-10 illustrate examples of what may be considered simplified partial side views of different representative configurations of inner ports and cavities of combiner/dividers that may be used. The combiner/dividers are considered to be like combiner/divider 10 except for the differences illustrated in these figures. Output/input waveguide 14 and aggregate port 56 are to the left of the portions shown and the input/output waveguides extend to the right of the views shown. Many configurations are possible and the ones shown are illustrative only.

Figure 7:
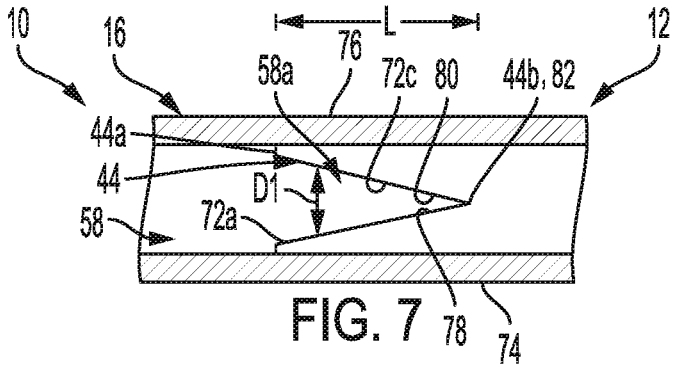
FIG. 7 is a simplified cross section of a side profile of a dual linear-tapered input/output waveguide inner port and associated extension of the transition cavity corresponding to the configuration of the embodiment shown in FIGS. 1-6.

FIG. 7 illustrates the configuration of combiner/divider 10 described above with reference to FIGS. 1-6. In this example, inner-port waveguide edge 72*a* is a mirror image of inner-port waveguide edge 72*c* and corresponding distal surface 78 is a mirror image of distal surface 80. Waveguide edges 72*a* and 72*c* also extend in a straight line the full longitudinal length L of inner ports 44 from extremity port end 44*a* to completion port end 44*b*. In other examples, not shown, the waveguide edges may extend in straight lines for only a portion of length L of the inner ports. Waveguide edges 72*a* and 72*c*, as well as distal surfaces 78 and 80 of distal region 58*a* of cavity 58, are separated by a distance D1 that decreases with increasing distance away from aggregate port 56.

Figure 8:
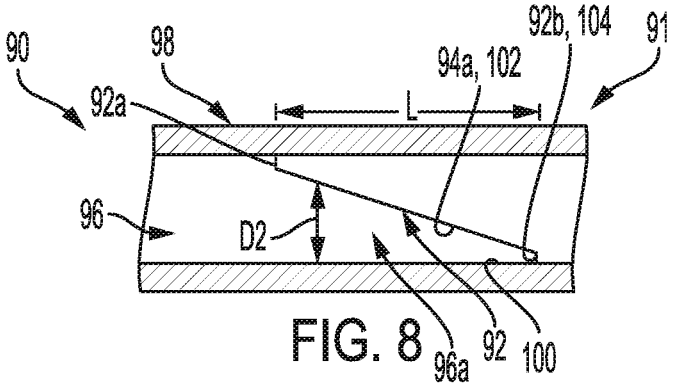
FIG. 8 is a view similar to FIG. 7 but showing a mono-linear-tapered input/output waveguide inner port and associated transition-cavity extension.

FIG. 8 illustrates the configuration of a combiner/divider 90 having input/output waveguides 91 having inner ports 92 with waveguide edges 94, including an inner-port waveguide edge 94*a*, but no corresponding opposite inner-port waveguide edge. A cavity 96 formed by a transitional waveguide 98 includes a distal region 96*a*. Transitional waveguide 98 includes opposite distal surfaces 100 and 102 that extend along the inner ports in the distal region.

In this example, waveguide edge 94*a* extends in a straight line the full longitudinal length L of each inner port 92 from an extremity port end 92*a* to a completion port end 92*b*. In other examples, not shown, the waveguide edges may extend in straight lines for only a portion of length L of the inner ports. Waveguide edges 94*a* and distal surface 100 are spaced from distal surface 102 by a distance D2 that decreases with increasing distance away from the aggregate port. Distal surfaces 100 and 102 are mirror images of each other and converge distal of the aggregate port at an extremity edge 104 aligned with the inner-port extremity port ends 92*a*.

Figure 9:
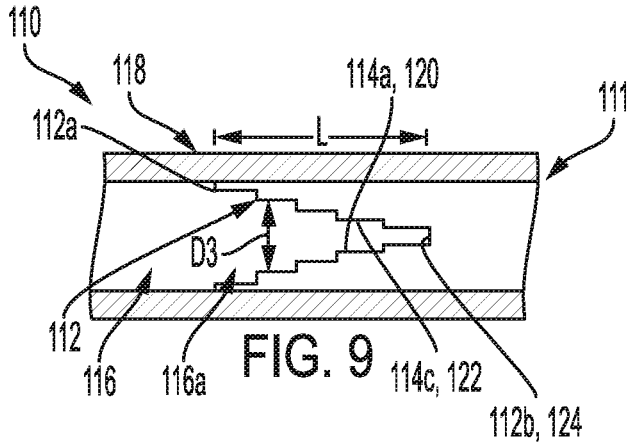
FIG. 9 is a view similar to FIG. 7 but showing a dual-stair-step-tapered input/output waveguide inner port and associated transition-cavity extension.

FIG. 9 illustrates the configuration of a combiner/divider 110 having input/output waveguides 111 having inner ports 112 with waveguide edges 114, including opposing inner-port waveguide edges 114*a* and 114*c*. A cavity 116 formed by a transitional waveguide 118 includes a distal region 116*a*. Transitional waveguide 118 includes opposite distal surfaces 120 and 122 that extend along the inner ports in the distal region.

In this example, waveguide edges 114*a* and 114*c* extend in a stair-step line the full longitudinal length L of each inner port 112 from an extremity port end 112*a* to a completion port end 112*b*. In other words, the distance between waveguide edges 114*a* and 114*c*, as well as between distal surfaces 120 and 122, decreases in discrete steps with increasing distance away from the aggregate port. Waveguide edges 114*a* and 114*c*, and correspondingly distal surfaces 120 and 122, are mirror images of each other and converge distal of the aggregate port at an extremity edge 124 aligned with the inner-port extremity port ends 112*a*. In other examples, only one of waveguide edges 114*a* and 114*c* may extend in a stair-step line, and there may be input/output-port waveguide edges on only one of the combiner/divider components.

Figure 10:
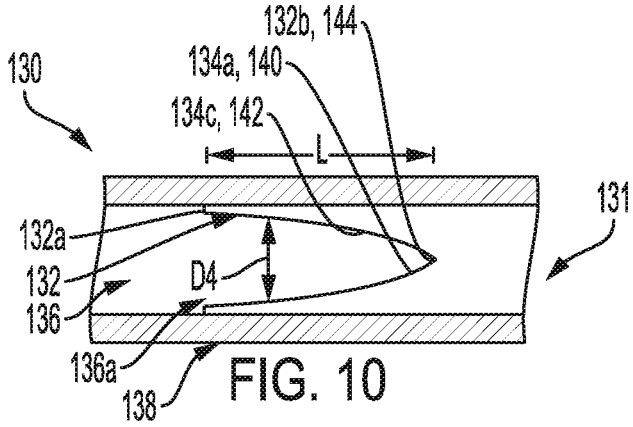
FIG. 10 is a view similar to FIG. 7 but showing a dual-curvilinear-tapered input/output waveguide inner port and associated transition-cavity extension.

FIG. 10 illustrates the configuration of a combiner/divider 130 having input/output waveguides 131 with inner ports 132 formed in part by waveguide edges 134, including opposing inner-port waveguide edges 134*a* and 134*c*. A cavity 136 formed by a transitional waveguide 138 includes a distal region 136*a*. Transitional waveguide 138 includes opposite distal surfaces 140 and 142 that extend along the inner ports in the distal region.

In this example, waveguide edges 134*a* and 134*c* extend in a curved line the full longitudinal length L of each inner port 132 from an extremity port end 132*a* to a completion port end 132*b*. Similarly, distal surfaces 140 and 142 also preferably extend in a curved line that conforms to the curved waveguide edges. Waveguide edges 134*a* and 134*c*, and correspondingly distal surfaces 140 and 142, are mirror images of each other and converge distal of the aggregate port at an extremity edge 144 aligned with the inner-port extremity port ends 132*a*. In other words, the distance between waveguide edges 134*a* and 134*c*, as well as between distal surfaces 140 and 142, decreases with increasing distance away from the aggregate port. In other examples, only one of waveguide edges 134*a* and 134*c* may extend in a curved line, and there may be input/output-port waveguide edges on only one of the combiner/divider components. The characteristics of the curvature of the waveguide edges and distal surfaces may by exponential, geometric, or other form.

The different embodiments of the combiner/divider described herein provide several advantages over known solutions for combining or dividing signals with low loss.

For example, the illustrative embodiments of combiner/dividers described herein allow combining and dividing a plurality of waveguide signals with low loss over a wide frequency band. More specifically, undesired reflections at input/output waveguide inner ports are reduced by in effect removing waveguide material from the tips of walls forming and surrounding the inner ports in the form of cut-outs in the waveguide walls, typically in a graduated fashion. This breaks-up undesired reflections into smaller reflections distributed along a longitudinal length of the inner ports, with the result that the reflections do not add up coherently, thereby reducing the overall composite reflection. This improves the impedance matching of the combiner/divider and reduces insertion loss, and thus improves efficiency. However, not all embodiments described herein provide the same advantages or the same degree of advantage.

The disclosure set forth above may encompass multiple distinct inventions with independent utility. Although each of these inventions has been disclosed in its preferred form(s), the specific embodiments thereof as disclosed and illustrated herein are not to be considered in a limiting sense, because numerous variations are possible. To the extent that section headings are used within this disclosure, such headings are for organizational purposes only, and do not constitute a characterization of any claimed invention. The subject matter of the invention(s) includes all novel and nonobvious combinations and sub-combinations of the various elements, features, functions, and/or properties disclosed herein. The following claims particularly point out certain combinations and sub-combinations regarded as novel and nonobvious. Invention(s) embodied in other combinations and sub-combinations of features, functions, elements, and/or properties may be claimed in applications claiming priority from this or a related application. Such claims, whether directed to a different invention or to the same invention, and whether broader, narrower, equal, or different in scope to the original claims, also are regarded as included within the subject matter of the invention(s) of the present disclosure.

Where "a" or "a first" element or the equivalent thereof is recited, such usage includes one or more such elements, neither requiring nor excluding two or more such elements. Further, ordinal terms, such as first, second, or third, for identified elements are used to distinguish between the elements in the order in which they are introduced in a particular context, and are not intended to show serial or numerical limitation, or be fixed identifiers for the group members. Accordingly, the ordinal indicator used for a particular element may vary in different contexts.

The invention claimed is:

1. A combiner/divider comprising:

a plurality of output/input walls having respective output/input-wall faces defining a three-dimensional output/input waveguide having an aggregate port;

a plurality of input/output walls having input/output-wall faces defining a plurality of at least three three-dimensional input/output waveguides distributed along a plane in side-by-side relationship, wherein each input/output waveguide extends from an outer node disposed distal of the aggregate port to an inner port proximate to and spaced from the aggregate port, wherein the inner port of each input/output waveguide extends from an extremity port end proximate to the aggregate port along a limited length of the respective input/output waveguide to a completion-port end distal of the aggregate port, the input/output-wall faces extend laterally discontinuously around the respective input/output waveguide at the extremity port end and along the limited length of the respective input/output waveguide, the input/output walls extend laterally continuously around each input/output waveguide at the respective completion-port end, and the input/output-wall faces include waveguide edges that define the inner ports; and a plurality of transition walls having respective transition-wall faces defining a transition waveguide with an open cavity communicatively coupling the aggregate port to each of the inner ports, wherein the cavity extends along opposing first and second distal surfaces that are distal of the aggregate port and extend continuously between the waveguide edges of adjacent inner ports of the plurality of input/output waveguides, the first and second distal surfaces are spaced apart by a distance that decreases with increasing distance from the aggregate port, and the first distal surface and corresponding waveguide edges conform to a portion of a first conical surface.

2. The combiner/divider of claim 1, wherein the waveguide edges include a first waveguide edge of each of the inner ports that extends from the respective extremity port end to the respective completion port end, and at least a portion of each first waveguide edge extends in a straight line.

3. The combiner/divider of claim 2, wherein the waveguide edges further include a second waveguide edge of each of the inner ports that extends from the respective extremity port end to the respective completion port end in opposition to the first waveguide edge, and at least a portion of the second waveguide edge also extends in a straight line.

4. The combiner/divider of claim 1, wherein the waveguide edges include a first waveguide edge of each of the inner ports that extends from the respective extremity port end to the respective completion port end and a second waveguide edge of each of the inner ports that extends from the respective extremity port end to the respective completion port end in opposition to the first waveguide edge, and the second waveguide edge is a mirror image of the first waveguide edge.

5. The combiner/divider of claim 1, wherein the second distal surface and corresponding waveguide edges conform to a corresponding portion of a second conical surface.

6. The combiner/divider of claim 1, wherein the first distal surface between each pair of adjacent inner ports are curved in conformation with the first conical surface between the corresponding adjacent waveguide edges.

7. A combiner/divider comprising:

a plurality of output/input walls having respective output/input-wall faces defining a three-dimensional output/input waveguide having an aggregate port;

a plurality of transition walls having respective transition-wall faces defining a transition waveguide with an open cavity communicatively coupled to the aggregate port, wherein the cavity includes a distal region spaced from the aggregate port, the transition waveguide includes opposing first and second distal surfaces in the distal region that are spaced apart by a distance that decreases with distance from the aggregate port, and the first distal surface conforms to a portion of a first conical surface; and a plurality of input/output walls having input/output-wall faces defining a plurality of at least three three-dimensional input/output waveguides distributed along a plane in side-by-side relationship, wherein each input/output waveguide is communicatively coupled to the cavity of the transition waveguide and thereby communicatively coupled to the aggregate port, each input/output waveguide extends from an outer node disposed distal of the aggregate port to an inner port proximate to and spaced from the aggregate port, and at least a first respective portion of each inner port conforms to and extends along the first distal surface toward the aggregate port.

8. The combiner/divider of claim 7, wherein the inner ports define corresponding openings in at least the first distal surface.

9. The combiner/divider of claim 8, wherein each inner port defines a respective opening extending along each of the first and second distal surfaces.

10. The combiner/divider of claim 7, wherein at least a portion of each inner port extends in a straight line along a portion of the first distal surface.

11. The combiner/divider of claim 10, wherein at least a portion of each inner port extends in a straight line along the respective portion of the first distal surface and also along a respective portion of the second distal surface.

12. The combiner/divider of claim 7, wherein the transition waveguide has an extremity edge distal of the aggregate port and the opposing distal surfaces converge along the extremity edge.

13. The combiner/divider of claim 7, wherein the portion of each inner port that extends along the first distal surface is a mirror image of the portion of the respective inner port that extends along the second distal surface.

14. The combiner/divider of claim 13, wherein the first and second distal surfaces are mirror images of each other.

15. The combiner/divider of claim 7, wherein the second distal surface conforms to a portion of a second conical surface, and at least a second respective portion of each inner port conforms to and extends along the second distal surface.

16. The combiner/divider of claim 7, wherein the first distal surface between each pair of adjacent inner ports are curved between the corresponding adjacent waveguide edges.

17. A combiner/divider comprising:

a plurality of at least three input/output waveguides distributed in a plane and diverging in at least a partially common direction away from a central point, wherein each input/output waveguide of the plurality of input/output waveguides extends from an outer node disposed distal of the central point to an inner port proximate to and spaced from the central point;

an output/input waveguide having an aggregate port proximate to the central point and facing the inner ports of the plurality of input/output waveguides; and a transition waveguide defining an open cavity extending from the aggregate port of the output/input waveguide to the inner ports of the plurality of input/output waveguides, wherein the transition waveguide flares outwardly in the plane from the aggregate port toward the inner ports and communicatively couples the output/input waveguide with the plurality of input/output waveguides, the cavity includes a distal region distal of the aggregate port, the transition waveguide includes opposing first and second distal surfaces in the distal region that are spaced apart by a distance that decreases with increasing distance from the aggregate port, the inner ports extend at least partially along the first and second distal surfaces toward the aggregate port as openings in the first and second distal surfaces, and the first distal surface conforms to a portion of a first conical surface.

18. The combiner/divider of claim 17, wherein the second distal surface conforms to a portion of a second conical surface, and at least a second respective portion of each inner port conforms to and extends along the second distal surface.

19. The combiner/divider of claim 17, wherein the first distal surface between each pair of adjacent inner ports are curved between the corresponding adjacent waveguide edges.

* * * * *